US008083986B2

(12) United States Patent
Choi et al.

(10) Patent No.: US 8,083,986 B2
(45) Date of Patent: Dec. 27, 2011

(54) FABRICATION OF ADVANCED THERMOELECTRIC MATERIALS BY HIERARCHICAL NANOVOID GENERATION

(75) Inventors: Sang Hyouk Choi, Poquoson, VA (US); Yeonjoon Park, Yorktown, VA (US); Sang-Hyon Chu, Newport News, VA (US); James R. Elliott, Vesuvius, VA (US); Glen C. King, Yorktown, VA (US); Jae-Woo Kim, Newport News, VA (US); Peter T. Lillehei, Yorktown, VA (US); Diane M. Stoakley, Ashland, VA (US)

(73) Assignees: National Institute of Aerospace Associates, Hampton, VA (US); The United States of America as represented by the Adminstration of NASA, Washington, DC (US)

( * ) Notice: Subject to any disclaimer, the term of this patent is extended or adjusted under 35 U.S.C. 154(b) by 0 days.

(21) Appl. No.: 12/315,520

(22) Filed: Dec. 4, 2008

(65) Prior Publication Data

US 2009/0185942 A1 Jul. 23, 2009

Related U.S. Application Data

(60) Provisional application No. 61/005,229, filed on Dec. 4, 2007, provisional application No. 61/005,226, filed on Dec. 4, 2007.

(51) Int. Cl.
*B28B 1/00* (2006.01)

(52) U.S. Cl. ..... 264/620; 264/614

(58) Field of Classification Search ..... 264/614, 264/620

See application file for complete search history.

(56) References Cited

U.S. PATENT DOCUMENTS

| | | | | |
|---|---|---|---|---|
| 4,491,679 | A * | 1/1985 | Moore | 136/203 |
| 4,686,320 | A * | 8/1987 | Novak et al. | 136/239 |
| 5,487,952 | A * | 1/1996 | Yoo et al. | 428/552 |
| 2003/0032709 | A1 * | 2/2003 | Toshima et al. | 524/439 |
| 2007/0240749 | A1 * | 10/2007 | Ohtaki | 136/200 |
| 2009/0004086 | A1 * | 1/2009 | Kuhling et al. | 423/276 |
| 2009/0072078 | A1 * | 3/2009 | Choi et al. | 244/30 |

FOREIGN PATENT DOCUMENTS

WO WO2007/077065 * 7/2007

* cited by examiner

*Primary Examiner* — Matthew Daniels
*Assistant Examiner* — Russell Kemmerle, III
(74) *Attorney, Agent, or Firm* — Kimberly A. Chateen

(57) ABSTRACT

A novel method to prepare an advanced thermoelectric material has hierarchical structures embedded with nanometer-sized voids which are key to enhancement of the thermoelectric performance. Solution-based thin film deposition technique enables preparation of stable film of thermoelectric material and void generator (voigen). A subsequent thermal process creates hierarchical nanovoid structure inside the thermoelectric material. Potential application areas of this advanced thermoelectric material with nanovoid structure are commercial applications (electronics cooling), medical and scientific applications (biological analysis device, medical imaging systems), telecommunications, and defense and military applications (night vision equipments).

5 Claims, 10 Drawing Sheets

Precursor M: metal (Au, Ag, Cu, Pb, Sn, Bi, etc.)

R: alkyl (COOH, COOR, etc.)

FABRICATION OF ADVANCED THERMOELECTRIC MATERIALS BY HIERARCHICAL NANOVOID GENERATION

CROSS REFERENCE TO RELATED APPLICATION

The present application claims priority from U.S. Provisional Application Ser. No. 61/005,229, filed Dec. 4, 2007 and U.S. Provisional Application Ser. No. 61/005,226, filed Dec. 4, 2007. This application is related to copending U.S. application Ser. No. 11/831,233, filed on Jul. 31, 2007 for "Configuration and Power Technology for Application-Specific Scenarios of High Altitude Airships," U.S. application Ser. No. 12/313,945, filed on Nov. 26, 2008 for "Metallized Nanotube Polymer Composite (MNPC) and Methods for Making Same", U.S. application Ser. No. 11/827,567 filed on Jul. 12, 2007 for "Fabrication of Metal Nanoshells," and U.S. application Ser. No. 12/315,519, filed on Dec. 4, 2008 for "Fabrication Of Metallic Hollow Nanoparticles", all of which are hereby incorporated by reference herein.

STATEMENT REGARDING FEDERALLY SPONSORED RESEARCH OR DEVELOPMENT

The U.S. Government has a paid-up license in this invention and the right in limited circumstances to require the patent owner to license others on reasonable terms as provided for by the terms of Cooperative Agreement No. NCC-1-02043 awarded by the National Aeronautics and Space Administration.

BACKGROUND OF THE INVENTION

1. Field of the Invention

The present invention relates to thermoelectric materials, and, more particularly to thermoelectric materials with low thermal conductivity, high electrical conductivity and a high figure of merit.

2. Description of Related Art

Today's thermoelectric (TE) device requires new compound materials with a high Seebeck coefficient, a high electrical conductivity (EC) and a low thermal conductivity (TC). Among the various TE materials that have been demonstrated thus far, the highest figure of merit for TE materials ("ZT factor") achieved is 2.5 using p-type 10 Å/50 Å $Bi_2Te_3/Sb_2Te_3$ superlattices. Conversely, the ZT for n-type 10 Å/50 Å $Bi_2Te_3/Sb_2Te_3$ superlattices is 1.46 at 300 K which is less than impressive. The performance of p-n junction devices for generators or coolers are dictated by the average value of ZT factors for both the p-type and n-type TE materials.

Good thermoelectric materials are characterized with high Z factor and its dimensionless product with the operating temperature, ZT (often called as the figure of merit for TE materials); $Z=S^2\sigma/\kappa$ and $ZT=S^2\sigma T/\kappa$, where S is the Seebeck coefficient (thermally generated open circuit voltage of material, μV/K), σ the electric conductivity (1/Ohm-cm), κ the thermal conductivity (mWatt/cm-K), and T the absolute temperature of operation (K).

Noticeable efforts to achieve high ZT have been made in searching for new TE materials that have an intrinsic high Seebeck coefficient, a high electrical conductivity, and a low thermal conductivity. Many TE materials have been brought into laboratory tests but the overall findings are less than impressive. Therefore, major efforts have been directed in part or in whole into structural modification of TE compound materials to enhance electrical conductivity while maintaining or reducing thermal conductivity. One of the examples is the superlattice structure of TE compound materials.

There are numerous applications for this potential breakthrough technology, such as power generation and active cooling devices. The cost savings by efficient TE materials with new nanovoid technology are immeasurable, especially for power generation applications for those spacecrafts in space exploration missions. The high figure of merit (ZT>5) of advanced TE generator will offer a high efficiency that may be competitive to high efficiency of most solar cells. The TE generator has much broader temperature range based on a specific TE material than band structure of solar cells. Multilayer of TE generators that cover a temperature range to another, respectively, will increase the overall efficiency, even better than the best known solar-cells. FIG. 4 shows the estimated figure of merit for the invented TE material technology.

Previously, poor TE properties of TE devices, including TE generators or TE coolers, have limited system design and application. The figure of merit (ZT) demonstrated so far is still much less than 4.0, the target value for p-n junction materials. It is well known that void structure in TE materials could improve overall TE performance. Nevertheless, most test samples with a certain void fraction have shown unsatisfactory performance due to failure in design and failure to synthesize proper nanovoid structure. For maximization of TE performance, the nanovoids need to maintain an optimized dimension comparable to the phonon mean free path so that they can reduce thermal conductivity by disrupting phonons without sacrificing electron transport.

The incorporation of nanovoids needs to enable reduction of thermal conductivity as well as increase of electrical conductivity, in order to maximize the thermoelectric figure of merit. In this regard, material design and synthesis are critical to achieving this goal since nature does not allow these two properties at the same time. Electrical and thermal conductivities usually change in the same direction, because both properties are, in most materials, originated from contribution of energetic electrons. TE materials with void structure have been studied in only a few systems, such as bismuth, silicon, Si—Ge solid solutions, Al-doped SiC, strontium oxide and strontium carbonate. One good example that showed positive influence of void incorporation was Si—Ge alloy samples prepared by conventional sintering-based method. In this case, a 30% increase in TE performance was observed with 15-20% void introduced. A recent approach to create nanoscale void structure was solution-based metalorganic deposition that involves metal precursors. Organic groups grafted to metal precursors are unstable and removed easily during heating process. The thermally-labile alkyl groups created nanovoid structure in bismuth metal film.

In the previous attempts to develop TE materials having a void structure, most of the void structures are poorly defined in terms of void size and interconnectivity. Conventional fabrication techniques don't allow a sophisticated control of nanoscale structure. Most void structures form interconnected void channels which disturb electron mobility and cause electrical failure. Typical void sizes in most of prior-art studies were in the micrometer range and thus phonon disruption was rarely observed.

An object of the present invention is to provide a thermoelectric material having a high figure of merit.

An object of the present invention is to provide a thermoelectric material having low thermal conductivity and high electric conductivity.

An object of the present invention is to provide a thermoelectric material having a void structure.

Finally, it is an object of the present invention to accomplish the foregoing objectives in a simple and cost effective manner.

SUMMARY OF THE INVENTION

The present invention addresses these needs by providing a method for fabricating thermoelectric materials. A mixture of a thermoelectric precursor, at least one dopant and a void generation material in a liquid solution is prepared and formed into a desired thickness. The formed material is heated in an oxygen atmosphere and then treated to remove any oxygen components remaining from heating the mixture in the oxygen environment. A crystalline structure is caused to be formed in the thermoelectric material. The precursor is preferably a plurality of nanoparticles of thermoelectric compound materials and most preferably is silicon, selenium, tellurium, germanium or bismuth. The precursor is most preferably bismuth telluride nanoparticles. The desired thickness of TE material is preferably prepared by spin-coating, solution casting or dipping. The thermoelectric material is preferably treated to remove any oxygen components remaining from heating the mixture in the oxygen environment and formation of a crystalline structure in the film is preferably accomplished by performing hydrogen calcination and hydrogen plasma quenching.

BRIEF DESCRIPTION OF THE DRAWINGS

A more complete description of the subject matter of the present invention and the advantages thereof, can be achieved by the reference to the following detailed description by which reference is made to the accompanying drawings in which.

DETAILED DESCRIPTION OF THE PREFERRED EMBODIMENT

The following detailed description is of the best presently contemplated mode of carrying out the invention. This description is not to be taken in a limiting sense, but is made merely for the purpose of illustrating general principles of embodiments of the invention.

The new technology presented here is based on the structural modification of TE materials by imbedding nanovoids to increase electrical conductivity and to decrease thermal conductivity to achieve ZT values greater than 5.0. The current invention teaches that the nanovoids imbedded within semiconductor materials enhance the electrical conductivity. Additionally, the electrical conductivity increases with the increasing fraction of nanovoids that were created by a porosity generator ("porogen"). This is a startling result. The inventors strongly believe that this result is the indication of electrons' ballistic behavior within a nanovoid under the wave-particle duality condition. On the other hand, the phonon within crystalline structures is a dominant property of thermal energy transfer. The nanovoids in crystalline structure impede phonon propagation by scattering, resulting in reduction of thermal conductivity. With these extraordinary features of nanovoids, enhanced figures of merit of the new TE materials are expected. The anticipated applications are very broad, such as TE power generators and TE coolers for sensors, diode lasers, and optical devices.

One method for creating nanovoids within TE materials is a sintering process for nanoparticles of TE compound materials mixed with nano-scale porogen elements. Once a batch of porogen nanoparticles is prepared with a thin-film lining material for void walls, the porogen is mixed into nanoparticles of TE compound materials, such as silicon (Si), selenium (Se), tellurium (Te), germanium (Ge) and bismuth (Bi). After mixing, the powder mix is compressed within a vacuum chamber to form a cake of the mix. This cake is placed inside a high temperature vacuum oven and heated up to a temperature where the porogen element is evaporated. While under the same temperature, evaporated porogen material is permeated out through interstices of sintered nanoparticles. Then the oven temperature is raised to a level where the sintered elements are fused together to form a bulk material while the shape of the nanovoids is maintained in tact without being collapsed. During this heating period, the metallic lining material is melted and coats over the inner surface of nanovoids without being diffused into the bulk material. Then the temperature is raised again to gradually anneal the bulk material for the growth of a crystalline structure.

Figure 1:
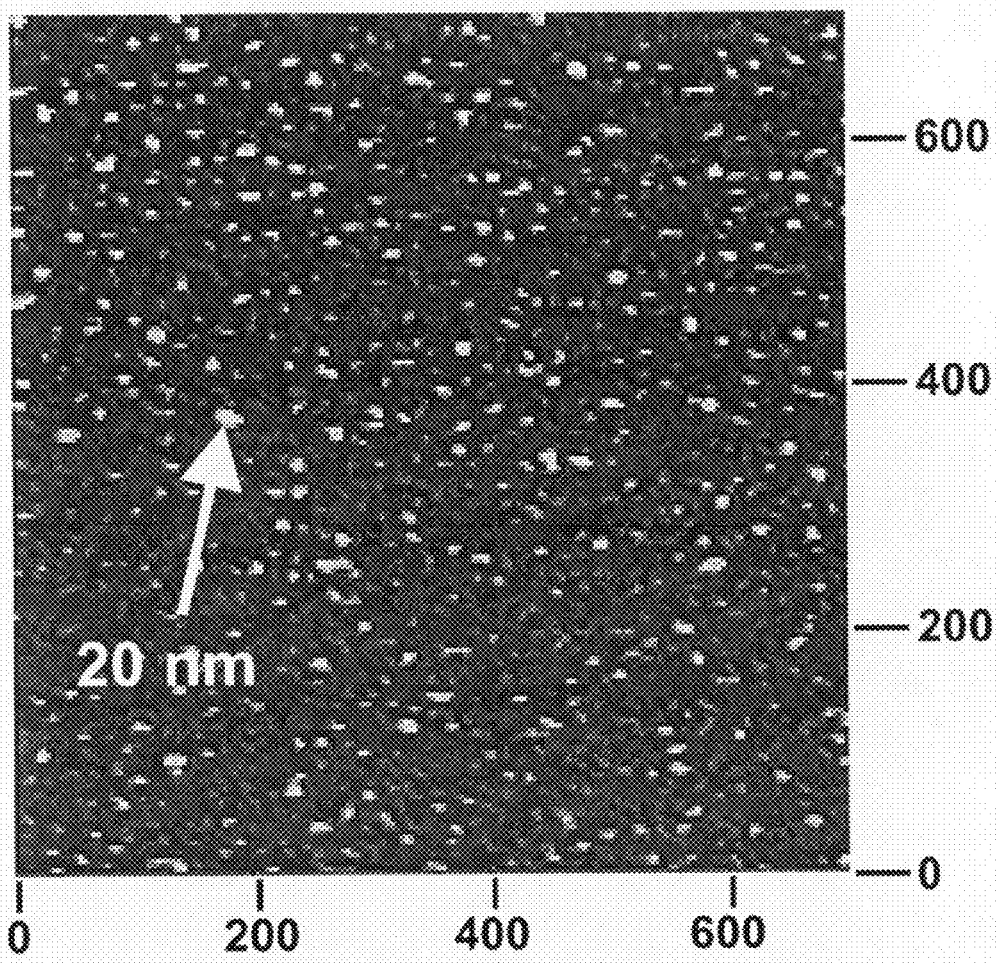
FIG. 1 shows an atomic force microscope (AFM) tapping mode image of laboratory grown nanovoids within methyl silsesquioxane (MSSQ)

Another method for creating nanovoids within TE materials is based on an advanced material processing technique that enables embedding the nanovoids into the semiconductor materials with porogen elements that are mixed into the epilayer during the semiconductor growth process. DC and RF Magnetron growth are used at a low substrate temperature and Rapid Thermal Annealing (RTA) is applied to activate, vaporize and remove the porogen elements from the semiconductor during the annealing process to create evenly populated nanovoids that are 3 nm to 20 nm in diameters. FIG. 1 shows the atomic force microscope (AFM) tapping mode image of our laboratory grown nanovoids within methyl silsesquioxane (MSSQ). The porogen used was a block copolymer. The overall material design scheme is shown in FIG. 2.

The electron transport property inside TE materials with nanovoids can be categorized in three ways: (1) the bulk doping concentration, (2) the metallic layer conduction, and (3) electron ballistic transport across nanovoids.

The EC can be increased with the shallow energy donors and acceptors by bulk doping concentration control. The impurities in the TE materials are controlled to a concentration that can maintain a good EC through the bulk volume and the bottleneck where TE material is sandwiched between nanovoids.

Figure 2:
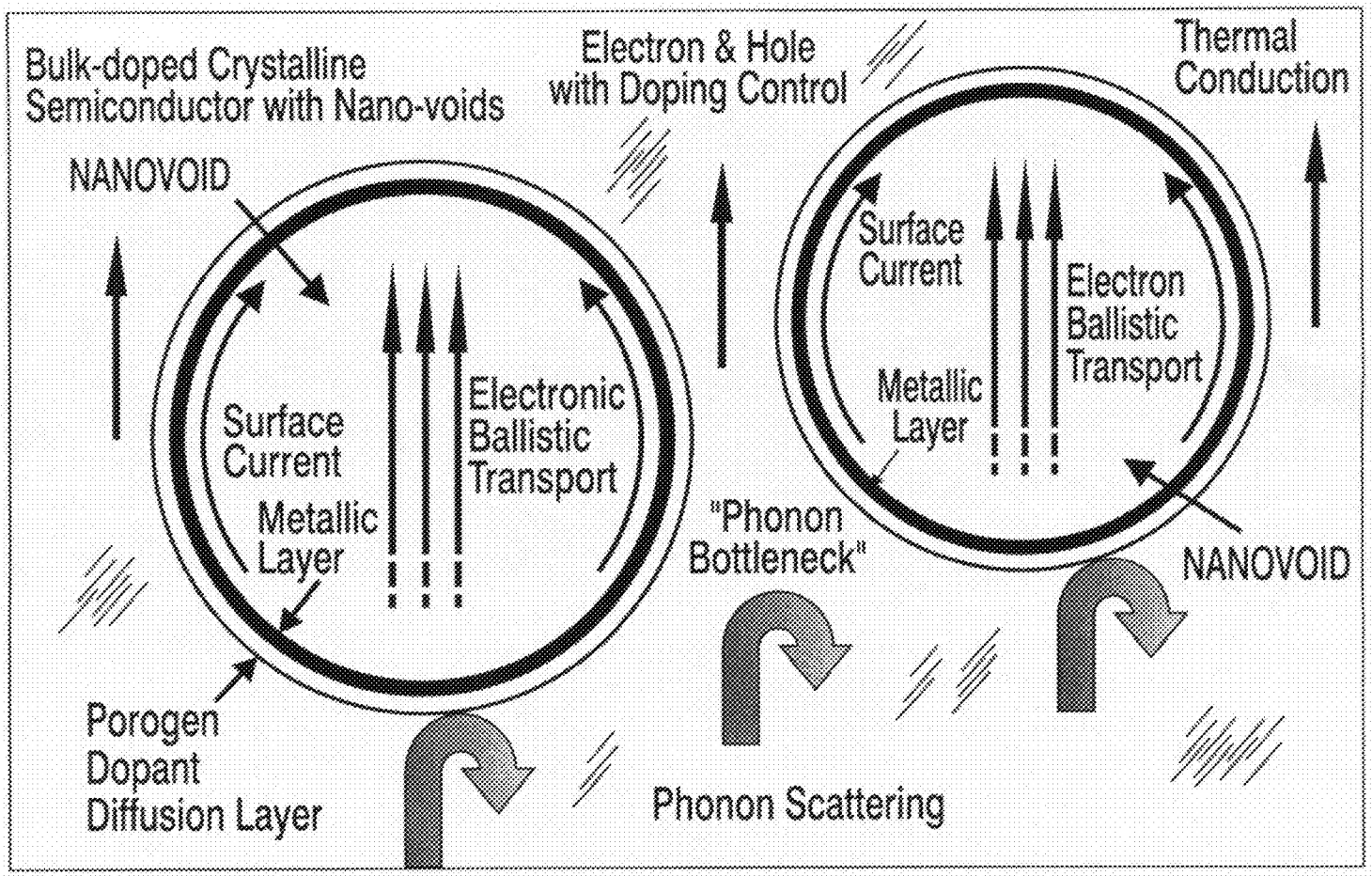
FIG. 2 shows a diagram of the process for fabricating advanced thermoelectric materials according to the present invention.

A metallic layer on each nanovoid wall is developed by a metallic porogen element of which the porogen alone is evaporated by heating and vanishes through the bulk TE material by diffusion, thus leaving a metal-coated nanovoid (see FIG. 2). This metallic layer increases the electrical surface current conductivity. When the material is annealed at a moderately high temperature for developing the crystalline structure of TE materials, the dispersed porogen elements within the bulk material are completely removed from the TE materials.

Figure 3:
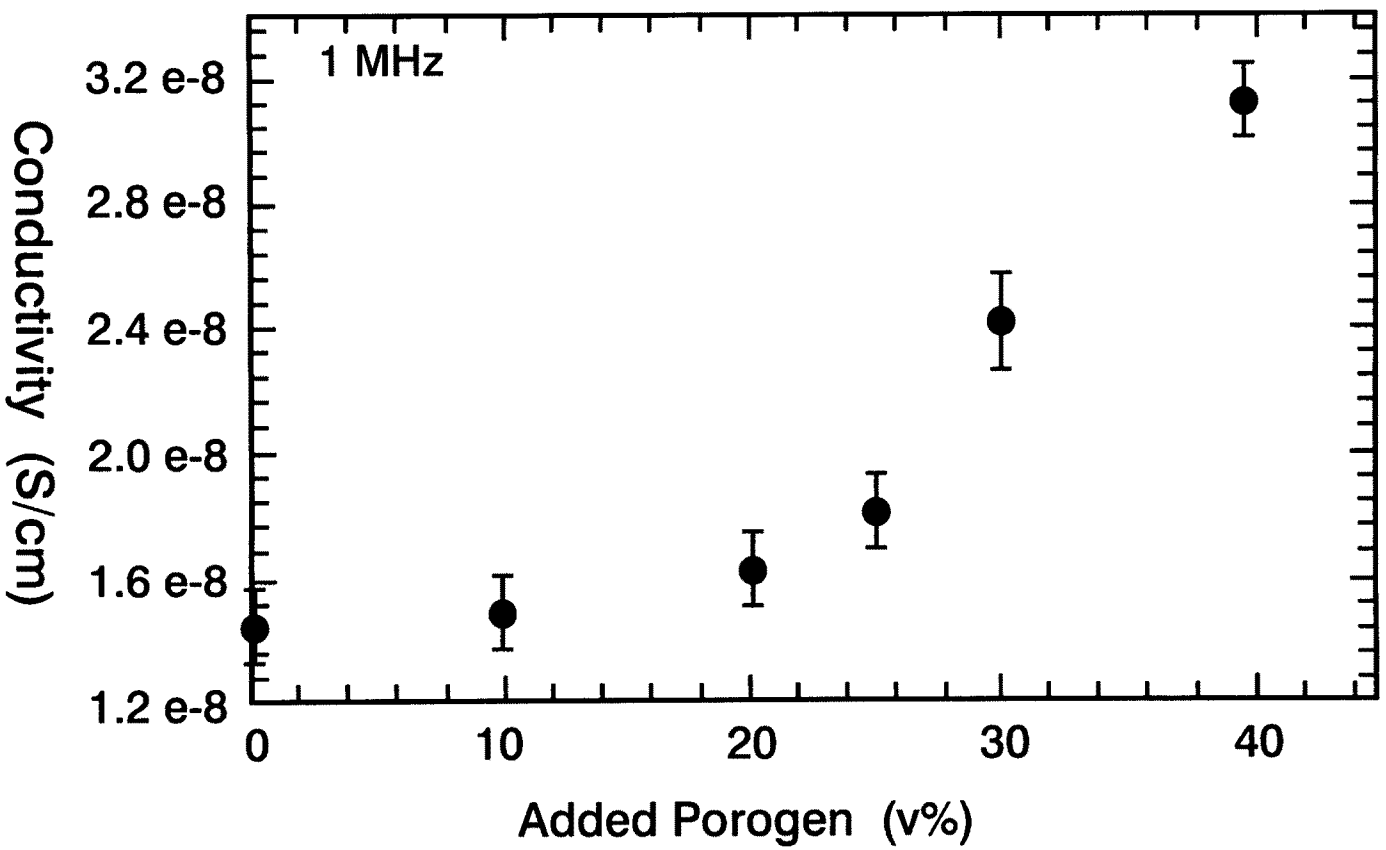
FIG. 3 shows a graph of the electrical conductivities measured with respect to void population.

The EC can be increased through electron ballistic transport process across nanovoids. The diameter, L, of a nanovoid is so small that electrons are able to ballistically traverse nanovoids without scattering. In other words, if the diameter of nanovoid is smaller than the inelastic electron-phonon scattering length, the traverse motion of electrons becomes ballistic. In this case, the dwell time, $\tau_e$, of electrons folds within the Ehrenfest time, $\tau_E$, that is determined by Fermi wavelength, $\lambda_F$, of electron wavepacket[i]. If we consider near-equilibrium electrons that are injected into nanovoids, the traverse current density is explained by Child's law: $J=[4\kappa_s\epsilon_o/9L^2]\sqrt{2q/m}\cdot V_A^{1.5}$. This relation explains that the current density of ballistic electrons across nanovoids is inversely dictated by the square of size of nanovoids. Therefore, the larger the number of nanovoid population and smaller the diameters of the nanovoids are, the more the EC is increased. FIG. 3 shows the electric conductivities measured with respect to the void population. Although the bulk material (MSSQ) is not a kind of TE material, the measured data shows the increasing trend of EC within the nanovoids ($L \leqq 20$ nm, see FIG. 1) populated within methyl silsesquioxane (MSSQ). It is an interesting result that needs further investigation to verify whether the ballistic transport property of electrons has any role. Note that neither was the MSSQ crystallized, nor did the nanovoids have a metal layer in FIG. 3.

In a crystalline structure, the imbedded nanovoids act as scattering sources against phonons with narrow bottleneck connections. This "phonon-bottleneck" is a more highly advanced materials design than the conventional "phonon-glass" design that uses impurity scattering for thermal insulation. In our approach, the nanovoids act as (1) phonon scattering sources and (2) thermal insulation volumes as well as (3) creators for the phonon bottleneck volume which minimizes the phonon transmission and maintains the structural integrity. Additional dopant diffusion into the phonon bottleneck area is possible with impurity mixing in the porogen elements. Additional impurities can be used for the phonon scatterings.

Figure 4:
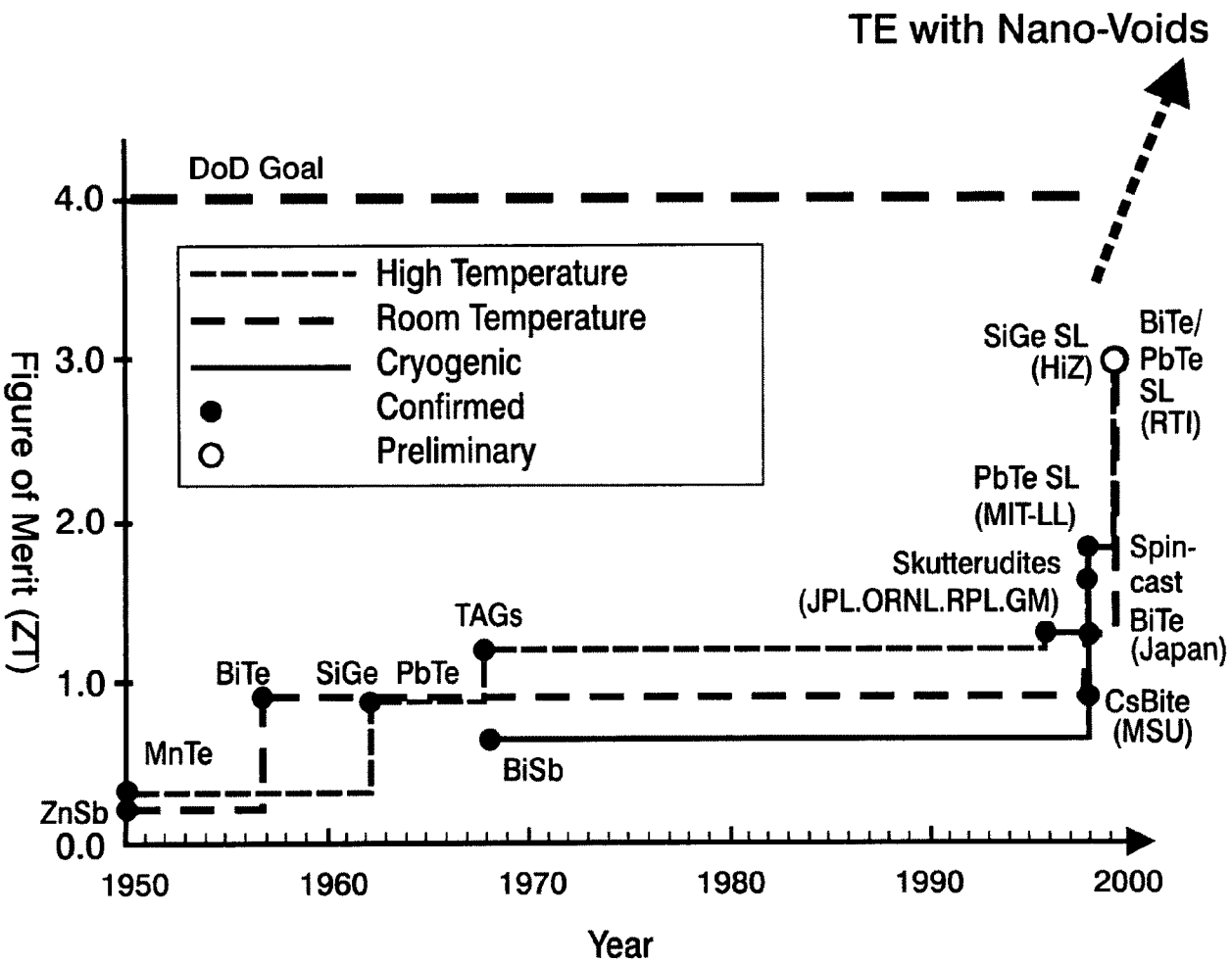
FIG. 4 is a diagram showing the history of the development of thermoelectric materials and the associated figure of merit.

The historic development of TE material is shown with the value of ZT in FIG. 4. The recent progresses were made with the quantum nano-structures, including SiGe or BiTe/SeTe super-lattices[ii], and Bi nano wires. Also, the bulk Clathrates & Skutterudites structures were utilized recently since they have open-cage structures which act as "electron-crystal and phonon-glass". However, there was only a limited capability to control the open-cages in these bulk materials. Our approach with nanovoids has superior controllability on electric and thermal properties in the material design when compared with existing technologies, since the concentration of nanovoids can be easily controlled with porogen, while the bulk doping and surface current can be separately controlled with the dopant and metallic porogen. Thus, we expect an order of magnitude improvement in TE material design with porogen generated nanovoids.

The next table shows the expected maximum figure of merit for SiGe alloys with the nanovoids and the metallic layer in our material development plan.

| | σ (1/Ohm*cm) | S (μV/K) | κ (mW/cm*K) | Z ($10^{-3}$/K) | ZT |
|---|---|---|---|---|---|
| $Si_{70}Ge_{30}$ at 650K with f = 0.3[Error! Bookmark not defined.] | 412.3 | 246.8 | 26.2 | 0.96 | 0.62 |
| SiGe with high doping (~1 × $10^{20}$/cm) & 50% nanovoids | 500 | 246.8 | 8.55 | 3.56 | 2.32 |
| SiGe with 50% nanovoids & thin metallic layer | 1180 | 246.8 | 8.55 | 8.40 | 5.46 |

The nanovoid-embedded advanced TE materials exhibit high figure of merit for TE devices. The main purpose of this invention is to incorporate a hierarchical nanovoid structure into thermoelectric (TE) materials using the solution-based metalorganic deposition (MOD) and the nanovoid generator (called "voigen") materials.

Figure 5:
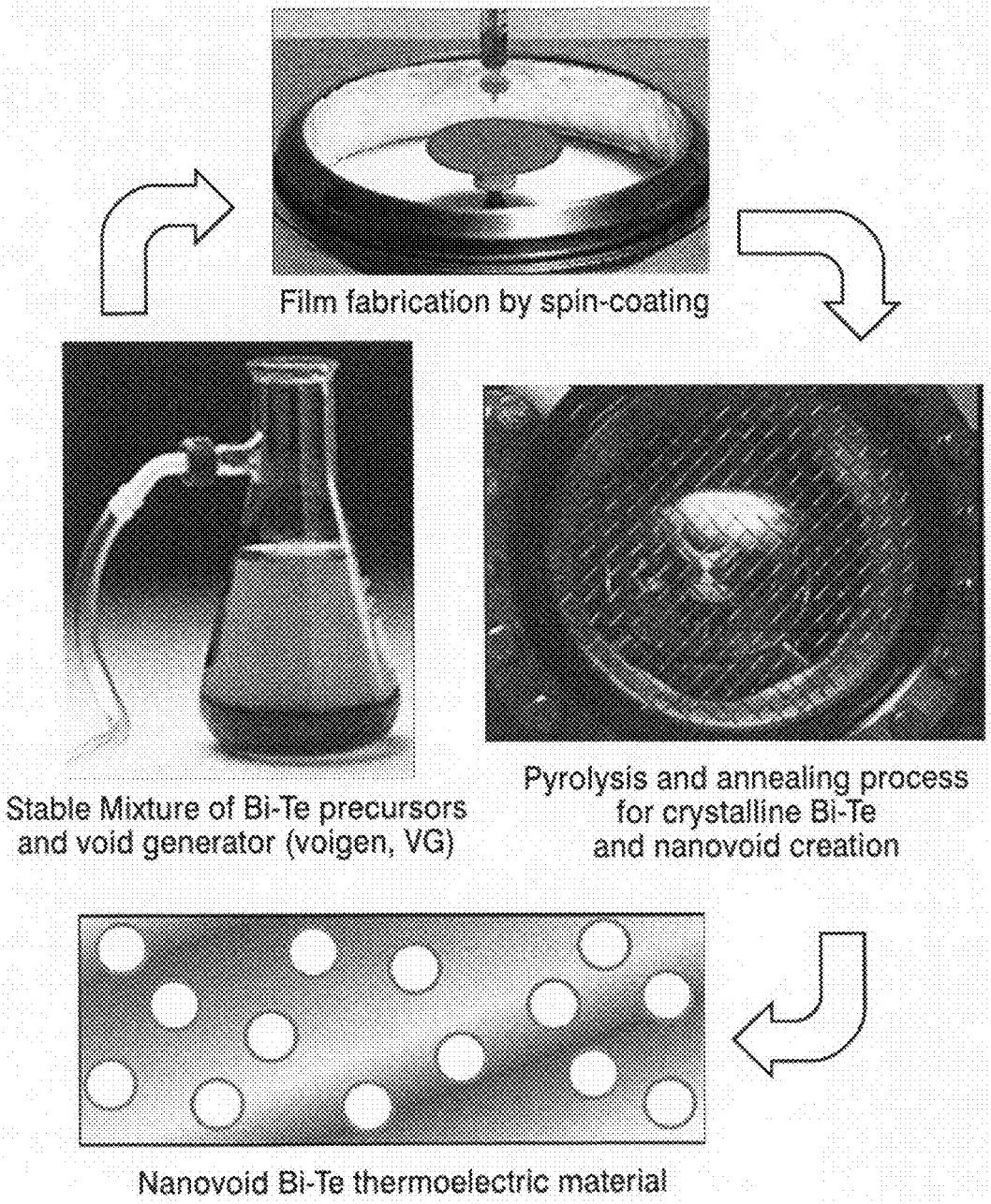
FIG. 5 is a diagram showing the steps involved in the present invention.

The concept of hierarchical approach consists of several major steps as illustrated in FIG. 5. First, a stable mixture of metal precursor (i.e. bismuth telluride), dopants for p-type or n-type, and voigen materials is prepared in liquid solution. A desired thickness of TE material is prepared using spin-coating, solution casting, or dipping method, before a TE material goes through the pyrolysis and annealing process to create nanovoid structure inside a bulk TE material. After the film deposition process, TE material film undergoes a calcination process to remove solvent residues and voigen core material. Through this process, the TE material film develops a fine TE material with nanovoid structure. To grow a crystalline structure of TE material after calcination (or pyrolysis) process, an annealing process is introduced to produce proper crystalline structure with nanovoids in a closed form.

Figure 6:
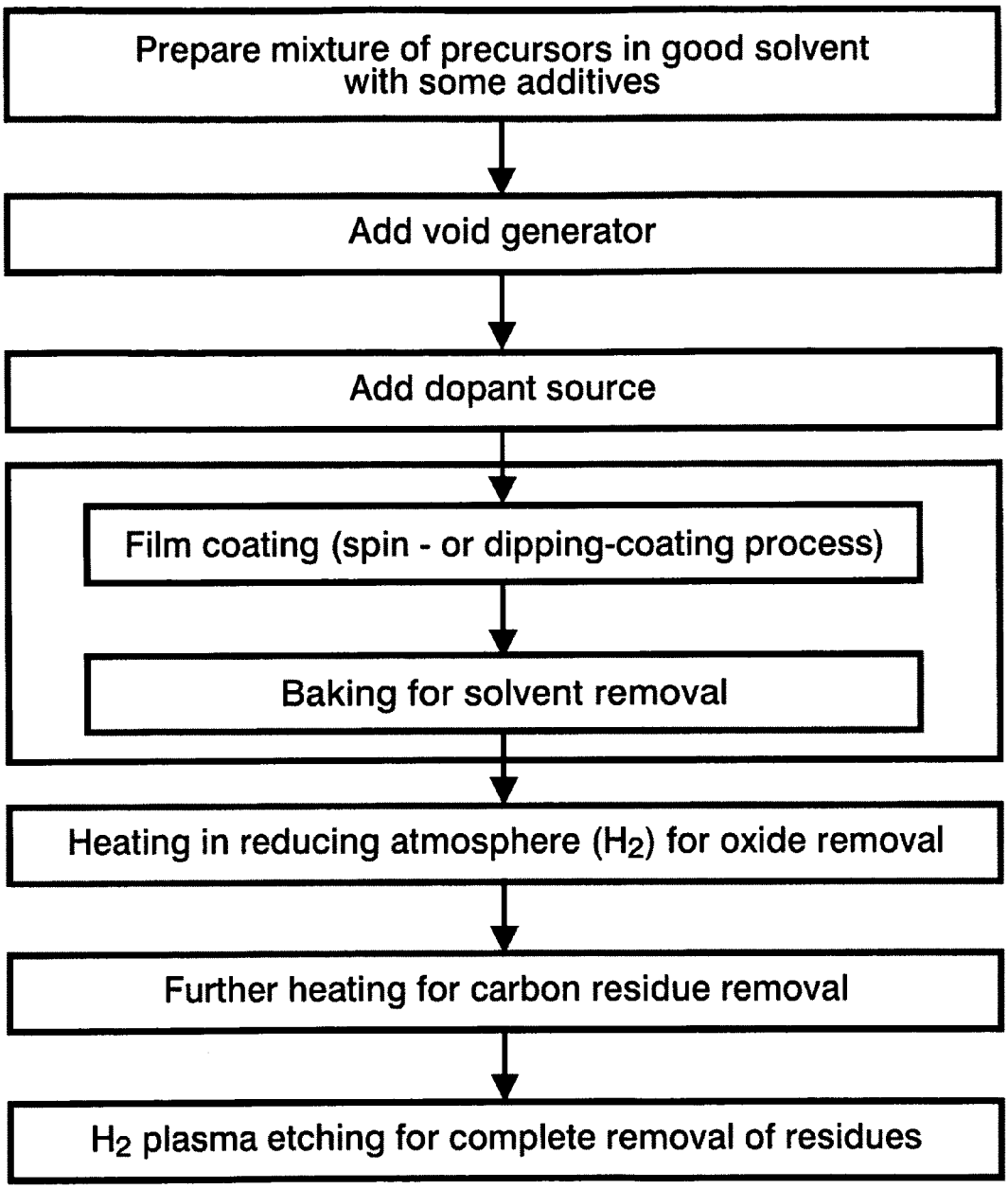
FIG. 6 is a block diagram showing the fabrication process of the present invention.

N-type and p-type thermoelectric material can be obtained by adding dopant materials (ex. Se and Sb in the case of bismuth telluride). Dopant for either p-type or n-type is impregnated into the bulk TE material by a diffusion process for a thin-film during annealing process or by mixing dopant precursor into a solution together with bulk material precursors and voigen material for a thick film. For a thin film case, the same process is repeated to develop multilayer structure until the desired thickness is achieved. Hydrogen environment is required to prevent bulk TE materials from developing oxides by residue oxygen gas or oxygen component of solvent and precursor materials during heating process. Additional heating process and hydrogen plasma etching process remove residual carbons and remaining oxide in TE film, respectively. A whole process in detail is illustrated in FIG. 6.

Molecular size of voids can be produced by thermally-labile groups in TE metal precursors. In the case of bismuth, its precursors with various forms $[Bi(OOC—R)_3]$ are available. Bismuth acetate $[Bi(OOC—CH_3)_3]$ is one example of bismuth precursors. When bismuth acetate is thermally decomposed in reduced environment with $H_2$, the following reaction occurs [see equation (1)]:

$$2BiO(OOCCH_3)(solid)+3H_2(gas)\rightarrow 2Bi(solid)+O(COCH_3)_2(gas)+3H_2O(gas) \quad (1)$$

The chemical reaction described in equation (1) gradually progresses when the reaction time is sufficiently long even at low temperature below bismuth's melting point. As a result of this, organic components including C, H, and O can be removed from metallic bismuth film. The gas-phase acetic anhydride $[O(COCH_3)_2]$ or water $(H_2O)$ evaporates or diffuses out through molecular free space of TE film.

Figure 7:
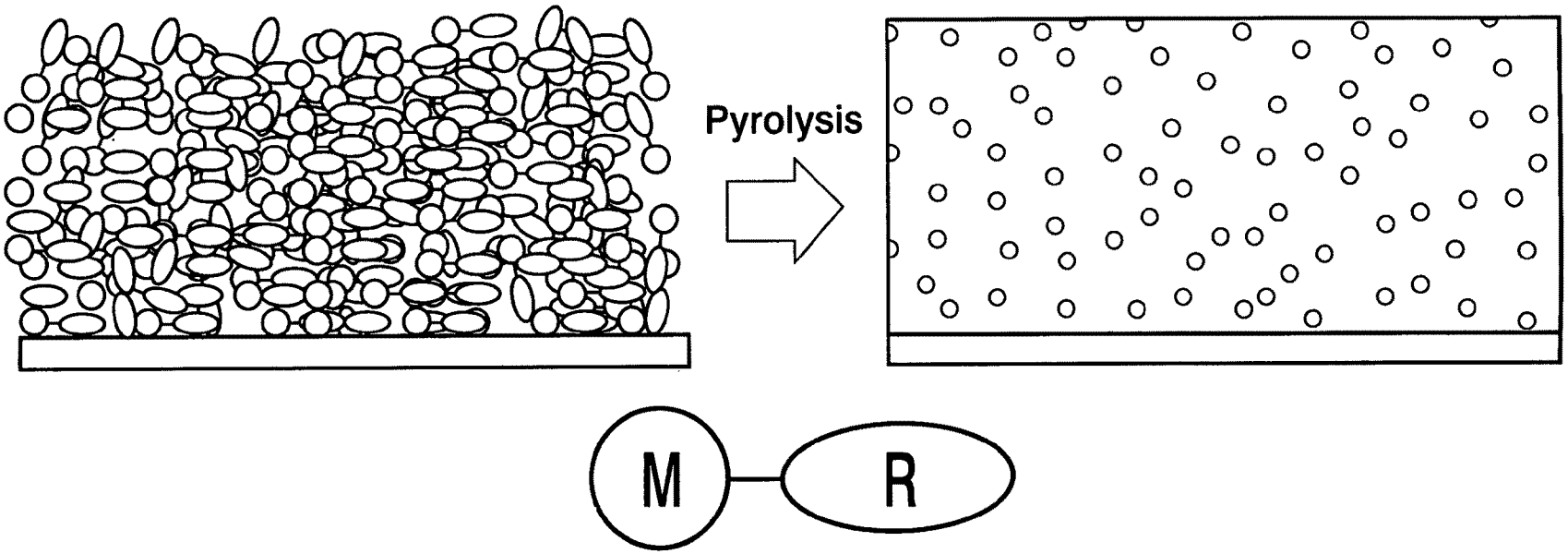
FIG. 7 is a diagram showing the formation of molecular voids.
Figure 8:
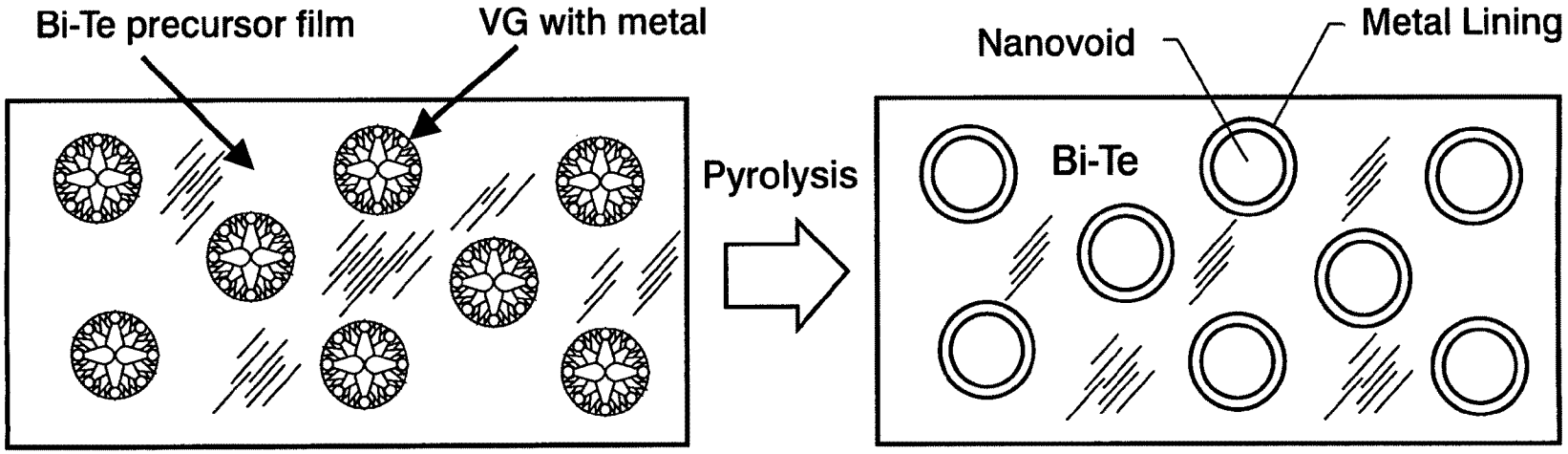
FIG. 8 is a diagram showing the formation of metal lines nanovoids.
Figure 9:
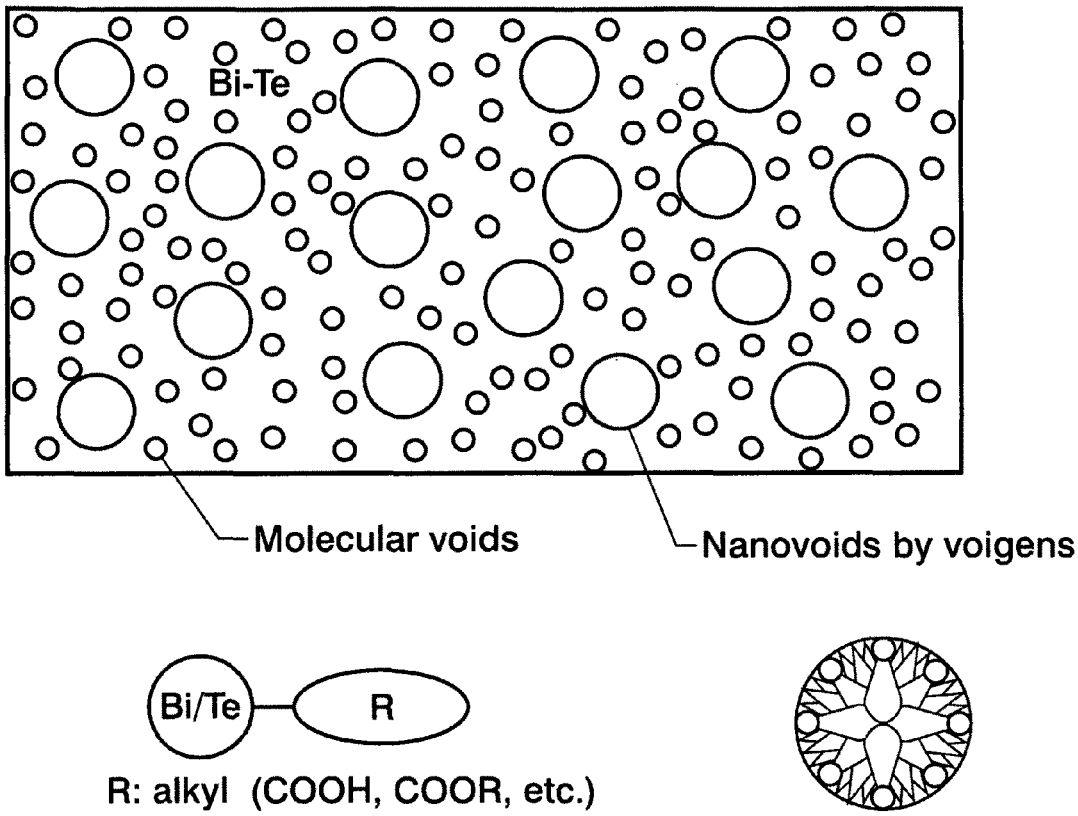
FIG. 9 is a cross-sectional view of an advanced thermoelectric material including nanovoids.

Accordingly, the alkyl groups (—R) determine precursor volatility as well as final void size (see FIG. 7). All of alkyl groups are removed and only metal atoms remain in final TE films. In addition to the molecular voids, different types of voids are simultaneously introduced by voigen materials (as shown in FIG. 8), leading to hierarchical void structure based on material design. Voigen materials mixed with metal precursors induce nanoscale phase separation according to thermodynamic phase equilibrium. The nanovoid structure can be controlled by thermodynamic miscibility and kinetic mobility between voigens and TE precursors. Processing condition of thermal treatment is also very important because it determines the final nanovoid structure by removing thermally-labile elements of both phases (see FIGS. 7 and 8). During the calcination and annealing processes, voigen core materials that are coated with nano-size metal particles will be dissociated and evaded out through the metal wall, thus leaving a well-distributed group of spherical metal nanovoids. Alternatively, the voigen core material is left to remain inside metal shell. The voigen core materials are not so thermally conductive that they will act as thermal blockades or as phonon scattering centers. The metallic shell of nanovoids with or without core material will be a passage of electrons. Such a structural design with metallic nanovoids offers the synthesis capability of high figure of merit TE material by increasing electrical conductivity and decreasing thermal conductivity at the same time. FIG. 9 shows the conceptual view of final nanovoid structure produced by two kinds of sacrificial groups.

Figure 10:
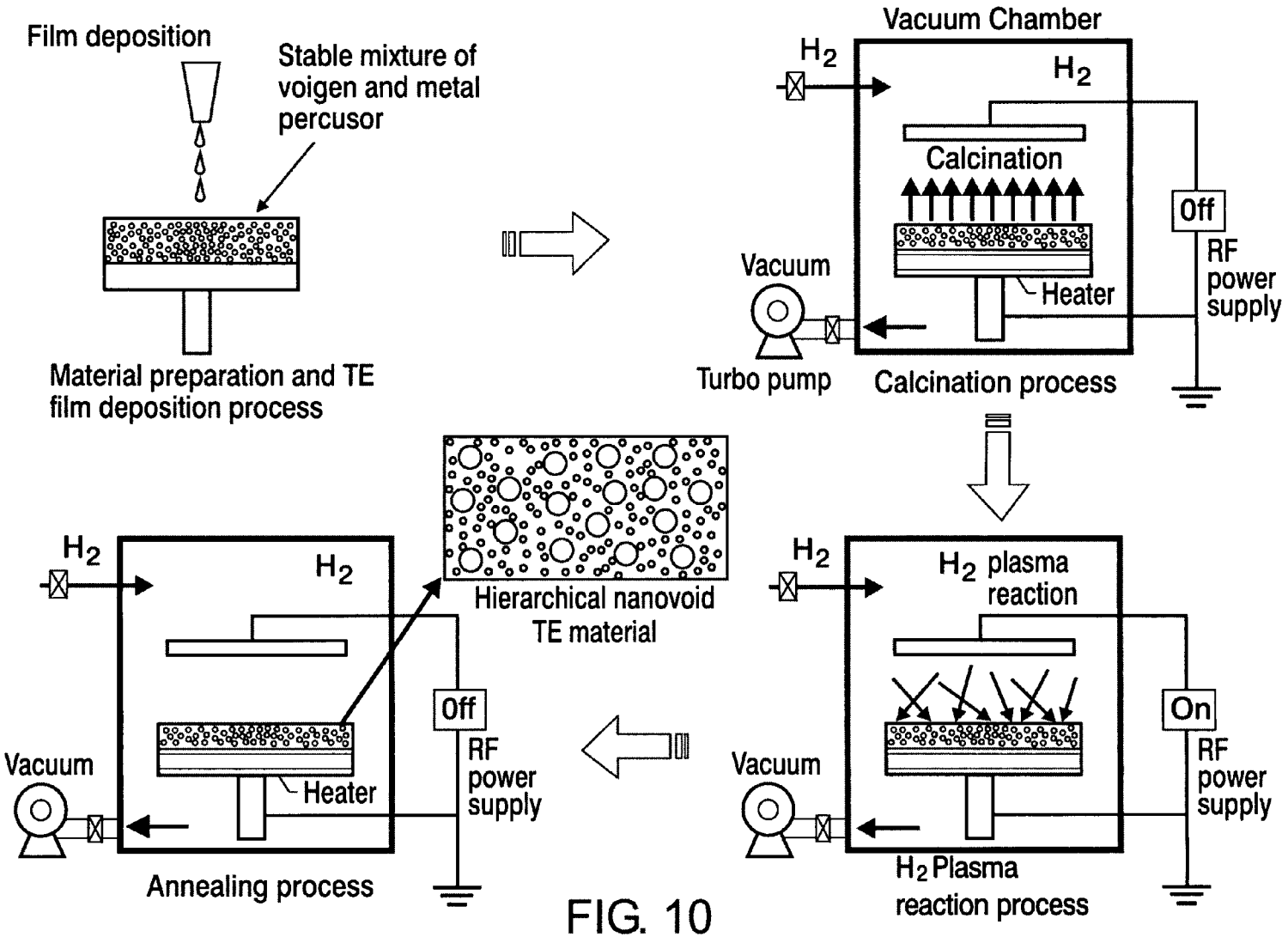
FIG. 10 is a diagram showing the fabrication method for the advanced thermoelectric material according to the present invention.

FIG. 10 illustrates the entire batch processes required for the advanced TE materials with hierarchical nanovoid structures, starting from preparation of metal precursor and voigen material to annealing process with film deposition process, calcination (or pyrolysis) process, and hydrogen plasma etching process as intermediate steps.

The novel fabrication technique described here is based on nanoscale phase separation. Nanovoid has finite dimension which is designed to cause phonon scattering without disturbing electron mobility. Additional enhancement comes from incorporating conducting elements. Atom-level metal lining inside nanovoid facilitates electron mobility through TE material. The final TE material is composed of hierarchical void structure in nanometer scale.

Nanostructure fabrication based on thermodynamic phase separation eliminates costly processes which are very complicated and very time-consuming. Such a spontaneous assembly simplifies a whole fabrication process and drastically increases process efficiency. Depending on target application area, thermoelectric figure of merit can be also designed by changing void size or void fraction. Hierarchical nanovoid structure not only gives more control in terms of material structure design but also increases threshold void fraction in terms of void interconnectivity. Moreover, typical sacrifice of mechanical properties due to void structure can be minimized by nanometer-sized mechanical defects dispersed in thermoelectric material. These benefits expected from nanovoid TE materials would bring a revolution in current technology.

Obviously, many modifications may be made without departing from the basic spirit of the present invention. Accordingly, it will be appreciated by those skilled in the art that within the scope of the appended claims, the inventions may be practiced other than has been specifically described herein. Many improvements, modifications, and additions will be apparent to the skilled artisan without departing from the spirit and scope of the present invention as described herein and defined in the following claims.

What is claimed is:

1. A method for fabricating thermoelectric materials, comprising:

preparing a mixture of a thermoelectric precursor, at least one dopant and a void generation material in a liquid solution;

preparing a desired thickness of the thermoelectric material from the prepared mixture;

heating the prepared thermoelectric material in an oxygen atmosphere;

following the heating, treating the thermoelectric material to remove any oxygen components remaining from heating the mixture in the oxygen environment such that a plurality of nanovoids are formed, each having a metallic layer on each inner surface of each formed nanovoid wherein the treatment step is accomplished by performing hydrogen calcination and hydrogen plasma quenching; and causing the formation of a crystalline structure in the thermoelectric material by performing hydrogen calcination and hydrogen plasma quenching.

2. The method as set forth in claim 1 wherein the precursor is a plurality of nanoparticles of thermoelectric compound materials.

3. The method as set forth in claim 1 wherein the precursor is selected from the group consisting of silicon, selenium, tellurium, germanium and bismuth.

4. The method as set forth in claim 1 wherein the precursor is bismuth telluride nanoparticles of TE compound materials.

5. The method as set forth in claim 1 wherein the desired thickness of TE material is prepared from a method selected from the group consisting of spin-coating, solution casting and dipping.

* * * * *